US006863324B1

(12) United States Patent
Nakajima

(10) Patent No.: US 6,863,324 B1
(45) Date of Patent: Mar. 8, 2005

(54) DROP-BOTTOM CONTAINER

(75) Inventor: Ritsuo Nakajima, 10-22, Nishisakata 1-chome, Kimitsu-shi, Chiba 299-1145 (JP)

(73) Assignees: Ritsuo Nakajima (JP); Nobuo Shouji (JP); Shinichi Hori (JP)

( * ) Notice: Subject to any disclaimer, the term of this patent is extended or adjusted under 35 U.S.C. 154(b) by 0 days.

(21) Appl. No.: 10/088,818

(22) PCT Filed: Sep. 30, 1999

(86) PCT No.: PCT/JP99/05369

§ 371 (c)(1),
(2), (4) Date: Dec. 31, 2002

(87) PCT Pub. No.: WO01/23280

PCT Pub. Date: Apr. 5, 2001

(51) Int. Cl.[7] ..... B65D 51/00
(52) U.S. Cl. ..... 294/68.24; 294/68.21
(58) Field of Search ..... 294/68.1–68.24, 294/110.1; 414/403, 411, 414

(56) References Cited

U.S. PATENT DOCUMENTS

| | | | | | |
|---|---|---|---|---|---|
| 1,762,797 | A | * | 6/1930 | Rohlfing | 294/68.24 |
| 2,824,762 | A | * | 2/1958 | Kaiser | 294/68.24 |
| 3,797,878 | A | * | 3/1974 | Fagre et al. | 294/68.21 |

FOREIGN PATENT DOCUMENTS

| | | |
|---|---|---|
| JP | 6-115869 | 4/1994 |

* cited by examiner

*Primary Examiner*—Dean J. Kramer
(74) *Attorney, Agent, or Firm*—DLA Piper Rudnick Gray Cary US LLP

(57) ABSTRACT

The invention, discloses a container including opening and closing shafts of bottom plates mounted in the vicinity of a bottom portion of a pair of side plates; engaging pins provided in the vicinity of tip ends of the bottom plates; a pair of opening and closing arms which are pivoted to opening and closing fulcrums fixed to the side plate and can retain the engaging pins at lower end portions; intermediate links having one end coupled to upper portions of the opening and closing arms; a block connected to other ends the intermediate links; a lifting rod screw-coupled to the block; a sleeve into which is inserted the lifting rod a rocker arm mounted in the vicinity of a lower end of the sleeve and ascends and descends together with the sleeve; a lifting-up arm coupled to the lifting rod via a pin; a manual lever inserted between the lifting-up arm and an upper end of the sleeve to be rotatable by 180° in a horizontal direction using the lifting road as a rotation shaft; and a stopper provided at a lower portion of the manual lever to prevent the manual lever from lowering, wherein both end portions of the rocker arm are engaged with upper end portions of the opening and closing arms, the lifting-up arm has one short arm and one L-shaped arm on both sides about the pin serving as a rotation center, a pushing-down pin is provided near to the rotation center of the short arm and a lifting hole is provided at a tip end of the L-shaped arm, and S-shaped slits which are fitted to the rocker arm in left and right directions at respective positions of opening and closing are provided in the opening and closing arms.

4 Claims, 9 Drawing Sheets

(a)

(b)

PRIOR ART

PRIOR ART

DROP-BOTTOM CONTAINER

RELATED APPLICATION

This is a § 371 PCT/JP99/05369, filed Sep. 30, 1999.

1. Technical Field

This invention relates to a container for accommodating and conveying bulk cargoes such as soil, scrap or the like and, in particular, to a bottom opening type container where a bottom plate is arbitrarily opened/closed according to only winding-up winding-down action of a crane by performing a simple operation so that its content can be discharged.

2. Background

In a portal crane such as an unloader equipped on a wharf, a grab bucket catches and lands coal or soil from a hold. Ascending/descending and opening/closing of this grab bucket can be performed by a remote control from an operator cab of the crane. However, this operation can be made only a grab bucket mounted to a crane through a wire rope and the bucket itself can not be moved to another place. Also, steel materials, scrap or the like can be moved and loaded by a lifting magnet. However there is a drawback that, in the case of stacked materials, only a material close to a surface of the stacked materials can be lifted. Therefore, the most efficient and universal cargo handling means comprises a container (bag). However, in the case of the container, much time is required for loading and discharging, which results in inefficiency. Therefore, such a container whose bottom wall can be opened and closed freely and where the bottom plate is opened by a simple operation, for example, releasing a lock to discharge the content is often used. However, there occurs such a case that a worker who performs the opening/closing operation of the container bottom plate when the content is discharged can not be viewed by the crane operator so that the worker is injured by falling, discharged materials, which poses a safety problem. For this reason, some containers are prepared in advance such that the bottom plate is automatically opened when the container is rolled down and it is rolled up again after landed and which does not require a worker to be near to the container at the time of discharging the contents.

As one example, a container described in Japanese Patent Application Laid-Open No. 06-115869 publication is explained with reference to the drawings. FIG. 9 is a front view of this container, and FIG. 10 is a plan view thereof, where 1 denotes a container, 11 (14*a*, 11*b*) denotes double-leafed hinged type bottom plates, 12 denotes opening and closing shafts of the bottom plates 11, 13 denotes side plates of the container 1, 91 denotes an engaging rod which engages opening and closing of the bottom plates 11, 92 denotes a pin attached to a tip portion of at least one of the bottom plates 11*a*, 11*b* to be engaged with a lower end portion of the engaging rod 91, 93 denotes an ascending and descending block formed at an upper end of the engaging rod 91, 94 denotes cam pieces supporting the ascending and descending block 93, 95 denotes a guide groove along the ascending and descending block 93, 941 denotes shafts about which the cam pieces 94 rotate, 96 denotes springs which urge the cam pieces 94 to be opened outwardly, 97 denotes springs lifting the bottom plates 2, 98 denotes a guide piece positioned slightly below the ascending and descending block 93 of the engaging rod, and ascends and descends within the guide groove 95 like the ascending and descending block 93, and 99 denotes a stopper functioning such that the guide piece 98 does not lower below a predetermined height.

In that container 1, the bottom plates 11*a*, 11*b* can be opened and closed from the vicinity of a central portion in a double-leafed hinged manner about the opening and closing shafts 12 provided in the vicinity of the both lower ends of the side plates 13. The pin 92 attached at a tip end of the bottom plates, for example, the bottom plate 11*a* is engaged with a lower end of the engaging rod 9l. Also, the other bottom plate 11*b* is engaged by the one bottom plate 11*a*. When the ascending and descending block 93 is put in a state where it is placed on an upper face of the cam piece 94, the cam piece 94 can not be rotated because it is pressed by the ascending and descending block 93, and the engaging rod 91 holds this state. For this reason, the bottom plates 11*a*, 11*b* are maintained such that their tip ends are lower than the lower edges of the side plates by the distance "h".

When the container 1 lands on a flat face and the engaging rod 91 is pushed up by the weight of the container 1, the ascending and descending block 93 floats up to open the cam pieces 94, so that the cam pieces 94 are rotated about the shafts 941 by the springs 96 to be opened. In this state, when the container 1 is lifted, the ascending and descending block 93 moves along the guide groove 95 without being prevented by the cam, pieces 94 and the bottom plates 11 are opened due to the weight of the contents and the weight of the bottom plates 11 so that the contents are discharged.

That is, when the container 1 is lifted to a predetermined position and again lands, the bottom plates 11 open automatically to discharge the contents.

In this manner, the container described in Japanese Patent Application Laid-Open No. 06-115869 publication can open the container bottom plates to discharge the content by only lifting-up and lifting-down operations conducted by a crane. However, in this container, there is a problem a) that, since a clearance of a distance h in a height direction is required in a bottom plate portion, the contents may drop due to its nature; and a problem b) that, once the container lands, the bottom plates are opened in any case.

An object of this invention is to provide a bottom opening type container which solves such problems, and where the bottom plates can be tightly closed without providing a clearance and where a selection about whether or not the bottom plates should be opened automatically can arbitrarily be made by a simple operation.

SUMMARY OF THE INVENTION

In one aspect, the invention relates to a bottom opening type container including a side plate (13) and a pair of bottom plates (11); opening and closing shafts (12) of the bottom plates (11) mounted in the vicinity of a bottom portion of the side plate (13); engaging pins (14) provided in the vicinity of tip ends of the bottom plates (11); a pair of opening and closing arms (57) pivoted to opening and closing fulcrums (573) fixed to the side plate (13) and can retain the engaging pins (14) at lower end portions; intermediate links (56) having one end coupled to upper portions of the opening and closing arms (57); a block (55) connected to other ends of the intermediate links (56); a lifting rod (52) screw-coupled to the block (55); a sleeve (53) into which is inserted with the lifting rod (52) a rocker arm (54) mounted in the vicinity of a lower end of the sleeve (53) and ascends and descends together with the sleeve (53); a lifting-up arm (51) coupled to the lifting rod (52) via a pin (521); a manual lever (531) inserted between the lifting-up arm (51) and an upper end of the sleeve (53) to be rotatable by 180° in a horizontal direction using the lifting rod (52) as a rotation shaft; and a stopper (58) provided at a lower portion of the manual lever (531) to prevent the manual lever from lowering, wherein both end portion of the rocker arm (54) are engaged with upper end portions of the opening and closing arms (57), the lifting-up arm (51) has one short arm and one L-shaped arm on both sides about the pin (521) serving as a rotation center, a pushing-down pin (513) is provided near to the rotation center of the short arm and a lifting hole (511) is provided at a tip end of the L-shaped arm, and S-shaped slits (571) which are fitted to the rocker arm (54) in left and right directions at respective positions of opening and closing are provided in the opening and closing arms (57).

In another aspect, the invention relates to a bottom opening type container including a side plate (13) and a pair of bottom plates (11); opening and closing shafts (12) of the bottom plates (11) mounted in the vicinity of a bottom portion of the side plate (13); engaging pins (14) provided in the vicinity of tip ends of the bottom plates (11); a pair of opening and closing arms (57) which are pivoted to opening and closing fulcrums (573) fixed to the side plate (13) and can retain the engaging pins (14) at lower end portions; intermediate links (56) having one end coupled to upper portions of the opening and closing arms (57); a block (55) which is connected to the other ends of the intermediate links (56); a lifting rod (52) screw-coupled to the block (55); a sleeve (53) into which is inserted with the lifting rod (52) a rocker arm (54) mounted in the vicinity of a lower end of the sleeve (53) and which ascends and descends together with the sleeve (53); and a lifting-up arm (51) coupled to the lifting rod (52) via a pin (521), wherein both end portions of the rocker arm (54) are engaged with upper end portions of the opening and closing arms (57), the lifting-up arm (51) has two arms extending in different directions by 90° about the pin (521) serving as a rotation center, lifting holes (511), (512) in the lifting-up arm, a pushing-down pin (513) mounted near to the rotation center of one arm, and S-shaped slits (571) fitted to the rocker arm (54) in left and right directions at respective positions of opening and closing are provided in the opening and closing arms (57).

In yet another aspect, the invention relates to a bottom opening type container further including a returning mechanism constituted by rotatably mounting the other end of a lever (6) having a tip end hook (61) to a side face of the bottom plate (11) and lifting an intermediate portion of the lever by a spring (62) is provided, the tip end hook (61) is engaged with the lifting-up arm (51) in a state where the bottom plate (11) has been opened at 90° and the lifting-up arm (51) has fallen down without being lifted upward.

DESCRIPTION OF THE INVENTION

A bottom opening type container of this invention is not lifted up directly when it is lifted up by a crane or the like, but it is configured such that a lifting-up rod for lifting up a container can ascend and descend relative to a container side plate and bottom plate receiving links provided at a lower end portion of the lifting-up rod restrain engaging pins positioned at tip ends of a container bottom plates from the below, the engaging pins are released only when the lifting-up rod is lowered relative to the side plate by an opening and closing mechanism so that the bottom plates can be opened. Therefore, when a releasing operation is performed, the bottom plates are released by landing the container so that the contents are discharged, and when the releasing operation is not performed, the cargo handling can be performed while the bottom plates are closed.

Alternatively, a portion to be lifted up by a crane is constituted of a lifting-up arm which has two arms and is rotatable by 90°, and the bottom plates are put in a closed state when the container is lifted up by one arm, while the bottom plates are put in a locked state when the container is lifted up by the other arm, so that opening and closing are controlled by changing the lifting-up state.

Figure 1:
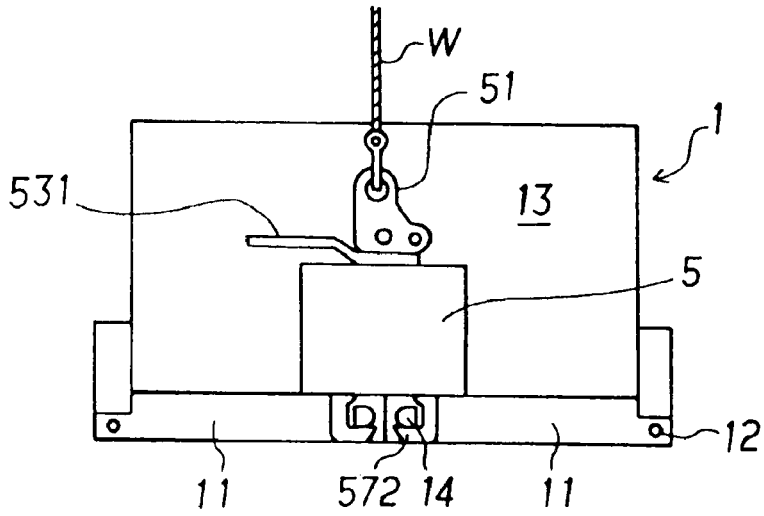
FIG. 1 is a front view showing a state where bottom plates of a bottom opening type container of a first embodiment of the present invention has been closed.
Figure 2:
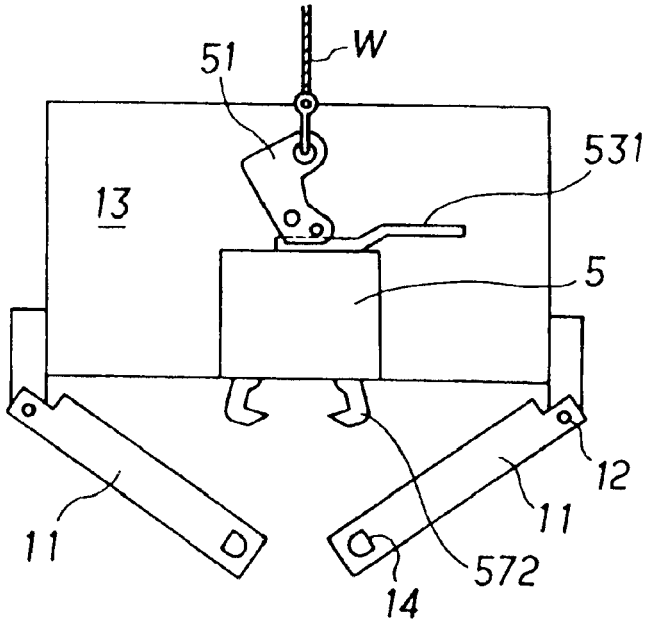
FIG. 2 is a front view showing a state where the bottom plates of the bottom opening type container of the first embodiment of the present invention has been opened.

A first embodiment of the present invention will be explained with reference to the drawings. FIG. 1 is a front view showing a state of a bottom opening type container 1 whose bottom plates have been closed. FIG. 2 is a front view showing a state of the bottom opening type container whose bottom plates have been opened, where the same reference numerals are used to parts common to FIGS. 9 and 10, and 5 denotes an opening and closing mechanism for the bottom plates 11, 51 denotes a lifting-up arm 51, 531 denotes a manual lever, 572 denotes engaging hook which opens and closes according to operation of the manual lever 531 and action of the opening and closing control mechanism 5 described later to retain the bottom plate 11, and 14 denotes an engaging pin provided at a tip end portion of the bottom plate 11 retained by the engaging hook 572.

Figure 9:
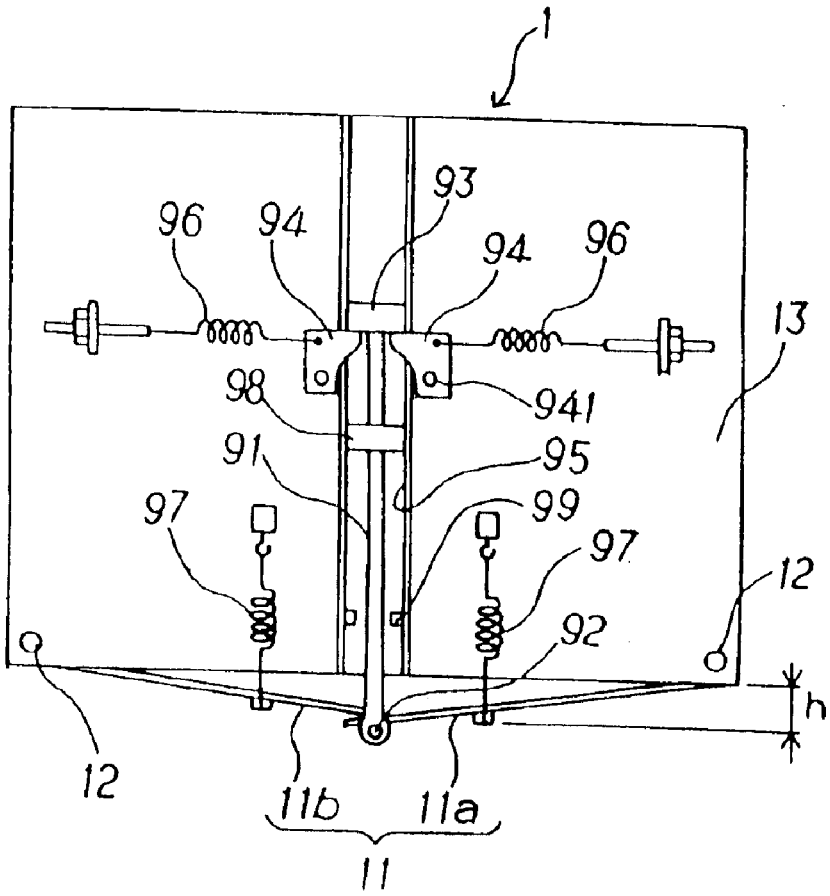
FIG. 9 is a front view of a bottom opening type container showing a conventional art.
Figure 10:
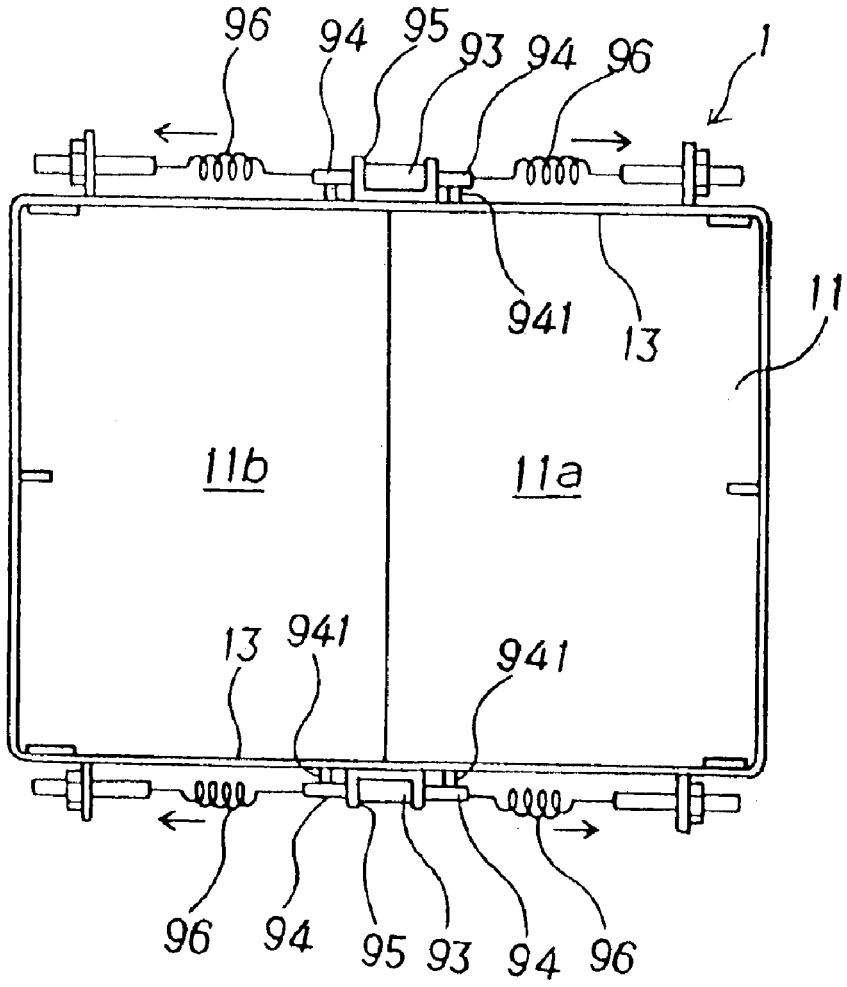
FIG. 10 is a plan view of the bottom opening type container showing the prior art.

As understood from FIG. 1, the bottom plates 11 of the container are approximately completely closed by engaging the engaging pins 14 with the engaging hooks 572, and it is unnecessary to provide such a clearance as viewed in FIG. 9 and described above.

Figure 3:
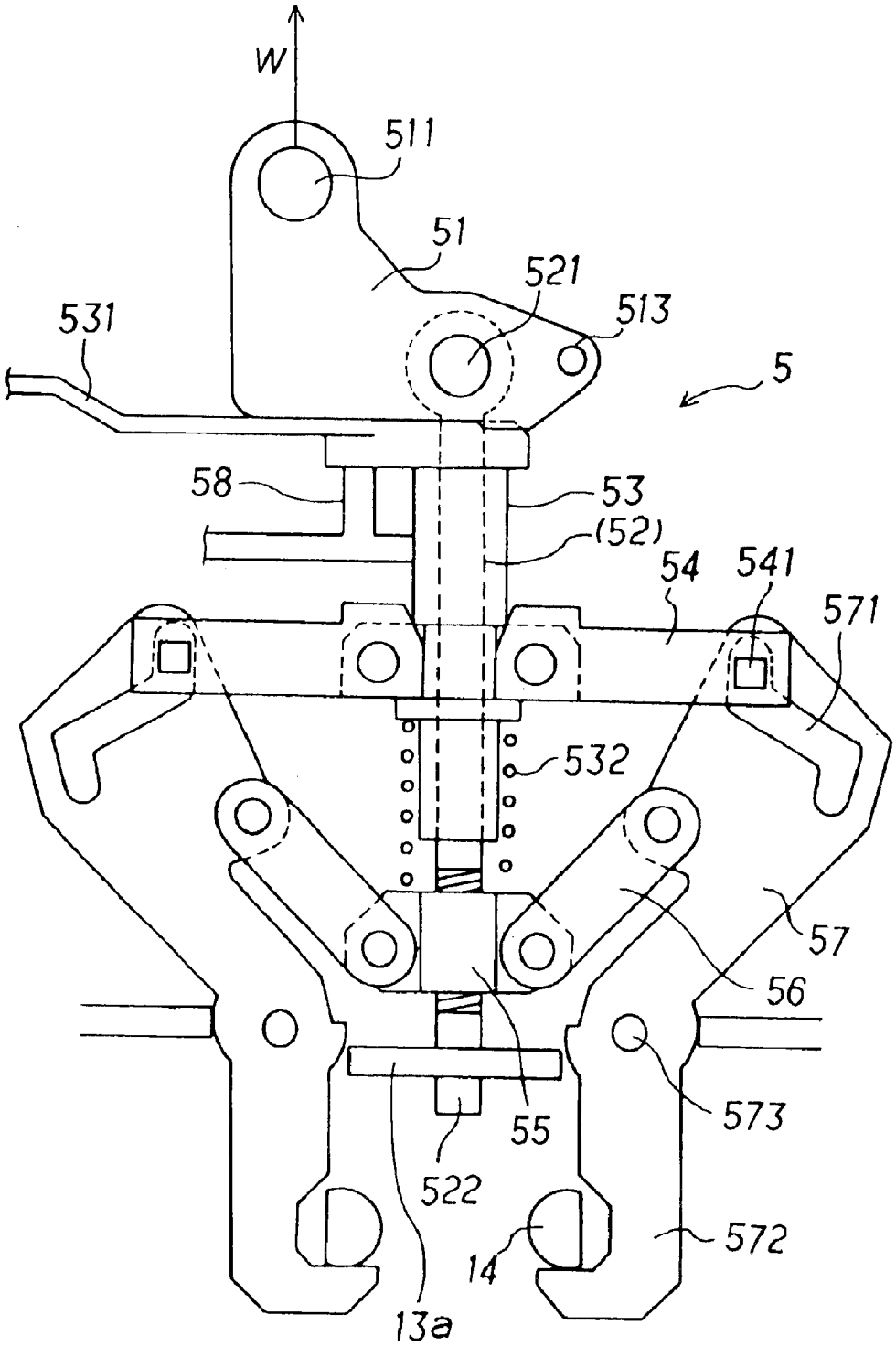
FIG. 3 is a partial front view showing an opening and closing control mechanism in the first embodiment of the invention.
Figure 4:
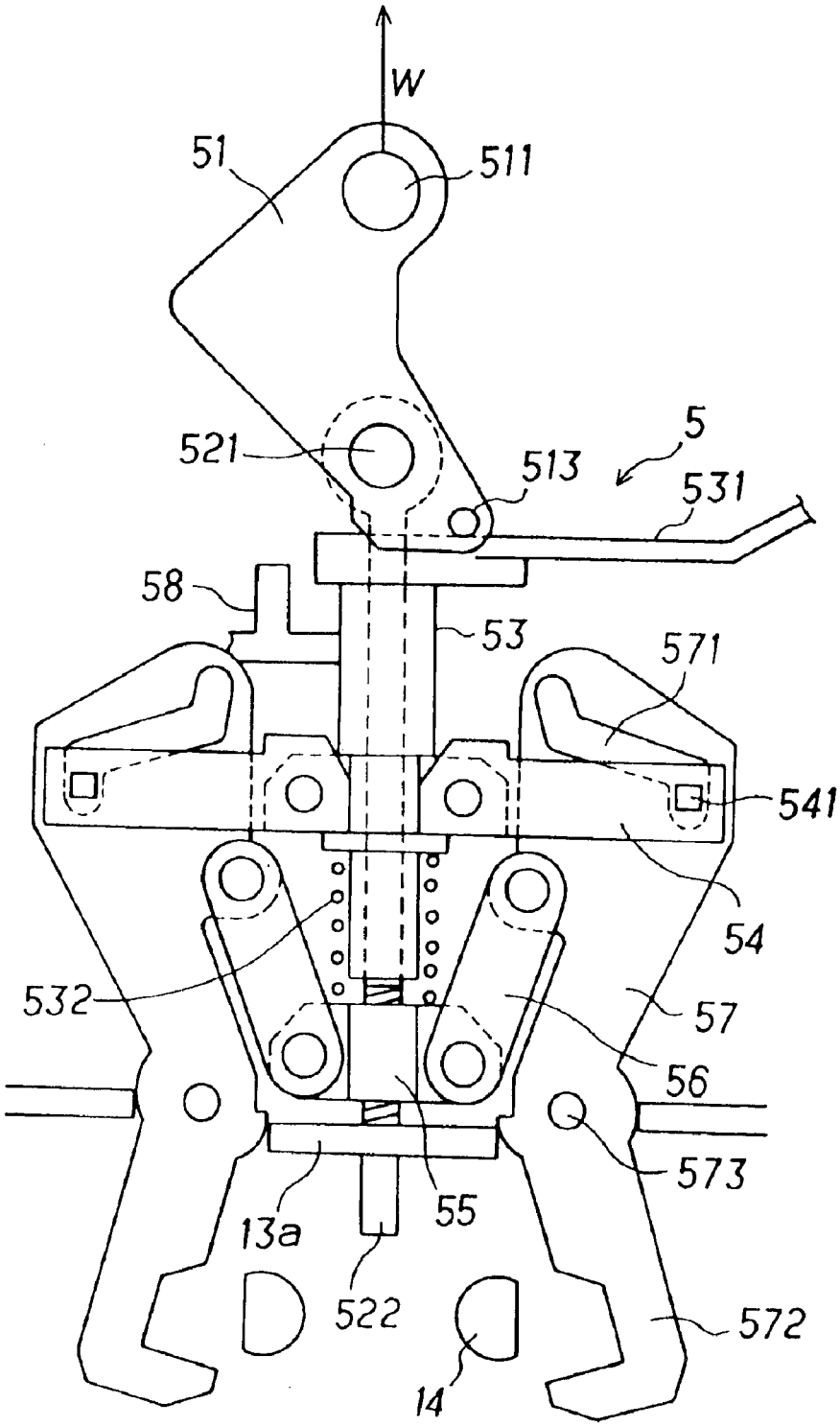
FIG. 4 is a partial front view showing the opening and closing control mechanism in the first embodiment of the present invention.

Next, the opening and closing control mechanism 5 will be explained. FIGS. 3 and 4 are front views which show the opening and closing control mechanism 5 in different states, respectively, according to the embodiment. The same reference numerals are used in parts common to the above-described embodiment. 51 denotes a lifting-up arm which is engaged with a hook when the container is lifted up by a crane or the like, 52 denotes a lift rod which is coupled to the lifting-up arm 51 via a pin 521, 53 denotes a sleeve in which the lifting rod 52 is inserted, 54 denotes a rocker arm which is mounted in the vicinity of a lower end of the sleeve to ascend and descend together with the sleeve, 55 denotes a block which is fixed to the vicinity of the lower end of the lift rod 52 through a screw connection, 56 denotes an intermediate link whose one end is connected to the block 55, and 57 denotes an opening and closing arm which is connected to the other end of the intermediate link 56. A spring 532 is inserted between a lower end of the sleeve 53 and the block 55, and the manual lever 531 which is rotatable by 180° in a horizontal direction using the lifting rod 52 as a rotation shaft is inserted between an upper end of the sleeve 53 and the lifting arm 51. Further, an extension portion 522 of the lifting rod 52 is screwed into the block 55 from below and it is inserted into a hole of a protrusion piece 13*a* in the vicinity of a container bottom portion, so that the protrusion piece serves as a guide when the lifting rod 52 ascends and descends. The opening and closing arm 57 is rotatable about an opening and closing fulcrum 573 provided on the container bottom portion. In a state where the lower end engaging,hook 572 is positioned vertically, as shown in FIG. 3, the hook engages the engaging pin 14 mounted to the bottom plate 11 of the bottom opening type container from the outside so that the hook maintains the bottom plate so as not to open. Further, an upper end portion of the opening and closing arm 57 is provided with a S-shaped slit 571 and it is engaged with a tip end portion of the above-described rocker arm 54 via a lock pin 541, and an upper arid intermediate portion thereof is connected with the other end of the intermediate link 56, as described above.

The lifting arm 51 has one short arm and one L-shaped arm on both sides of a pin 521 serving as a rotation center, and a pushing-down pin 513 is provided near to the rotation center of the former arm and a lifting hole 511 is provided at a tip end of the latter arm.

In FIG. 3, the manual lever 531 is positioned on the left side. The manual lever 531 is prevented from being lowered beyond this position by a stopper for a lever 58 mounted to a fixed portion or the like such as a container 1 main body or the like. For this reason, even when the container 1 is tried to be lifted up by engaging lifting-up means such as a lifting-up wire of a crane or the like with a lifting hole 511, the lifting arm 51 does not rotate. Also, the sleeve 53 is maintained at a raised position relative to the lifting rod 52. Therefore, the engaging hooks 572 are prevented from opening and the container is lifted while the bottom plates are closed.

Next, in FIG. 4, the manual lever 531 has been rotated by 180° to the right side by operating the manual lever 531. In this state, when the lifting hole 511 is engaged with the lifting-up means such as the lifting-up wire of the crane or the like to lift up the container 1, the lifting-up arm 51 is rotated because the manual lever 531 has been released from the stopper for a lever 58, so that the manual lever 531 is pushed down by the pushing-down pin 513 and further sleeve 53 is pushed down.

Since the block 55 is pushed down by this action, the upper portions of the opening and closing arms 57 are drawn inwardly by the intermediate links 56, the engaging hook portions 572 at lower ends are opened outwardly and the engaging pins 14 are released so that the bottom plates can be opened.

Figure 5:
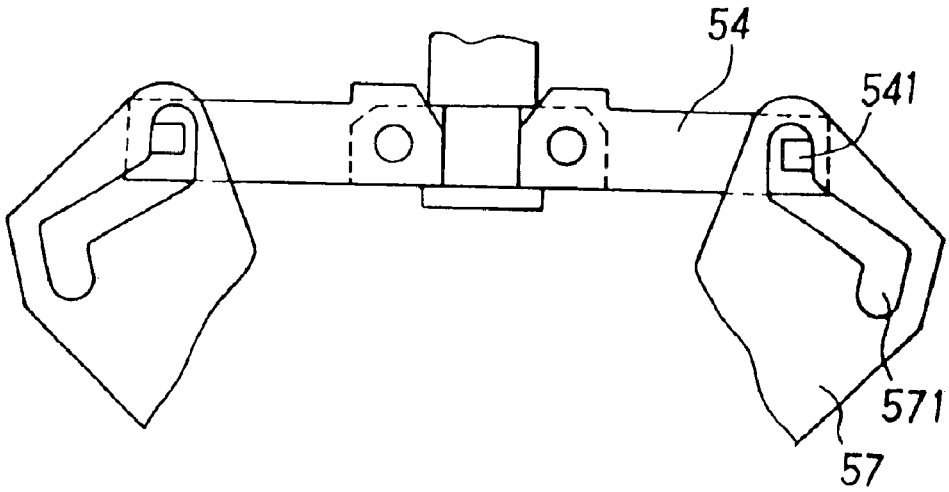
FIGS. 5*a–b* are partial front views showing a main portion of the opening and closing control mechanism in the first embodiment of the present invention.
Figure 5:
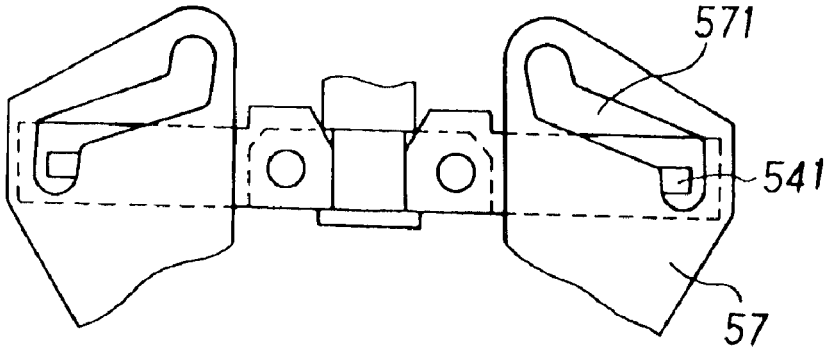

FIGS. 5 are explanatory diagrams showing the rocker arm 54 and the upper portions of the opening and closing arms 57, which correspond to opened and closed states of the opening and closing arms 57, that is, FIG. 5(*a*) corresponds to FIG. 3 and FIG. 5(*b*) corresponds to FIG. 4. The S-shaped slit 571 is provided at the upper portion of the opening and closing arm 57. In each of states where both end portions of the S-shaped slit 571 are respectively opened and closed, the lock pin 541 provided at the tip end of the rocker arm 54 is pushed on the slit so that the state at that time can be maintained. Therefore, working is performed such that the orientation of the slit relative to the lock pin 541 becomes vertical in each of the opened and closed states. It is preferable that a portion of the lock pin 541 which comes in contact with the slit is processed in a flat state.

Since the opening and closing control mechanism 5 of this embodiment has been configured in the above manner, one example of how to use the container will be explained as follows:

As shown in FIG. 3, the manual lever 531 is moved at the "Close" position on the left side, and even if the container is lifted up by using the lifting hole 511 to be moved or lifted down, the bottom plates do not open. The container is once landed and the manual lever 531 is rotated by 180° to be moved to the "Open" position on the right side. When the container is lifted up and lands again, the bottom plates open so that the contents are discharged. After the cargo is charged, when the empty container lands again and the manual lever 531 is returned back to the close position, cargo handling work can be performed with the container whose bottom plates have been closed, again.

In this embodiment, when the manual lever 531 is moved to the "Close" position, the bottom plates of the container are prevented from opening, and all operations of lifting and lowering, a transverse movement, and opening and closing of the container can be performed by only operations in the crane, so that it is unnecessary to approach a lifted cargo which is dangerous for a worker. In addition, since it can be confirmed clearly from a far position that the manual lever 531 is positioned at the "Close" position, all workers around the cargo can work safely.

Figure 6:
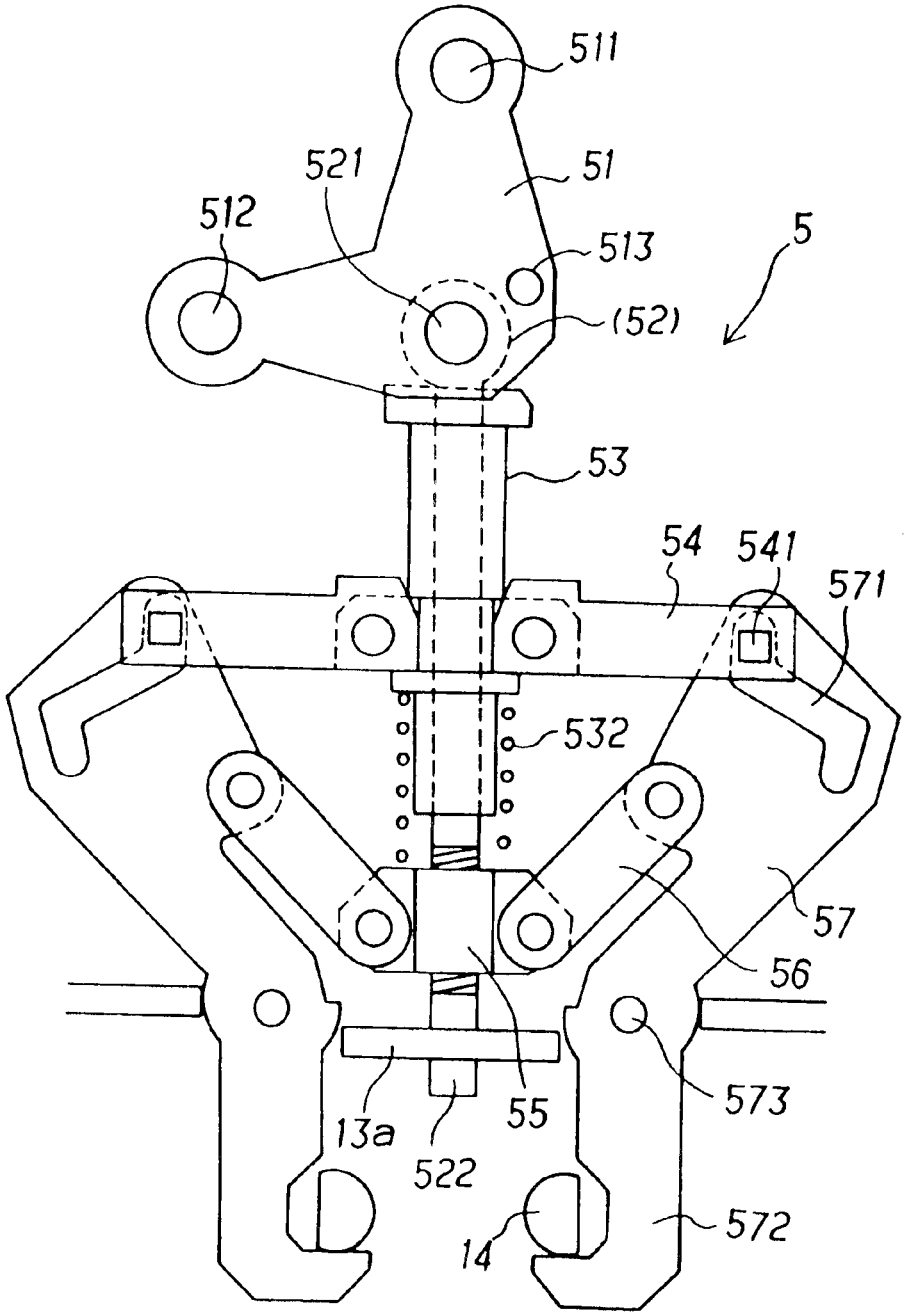
FIG. 6 is a partial front view showing an opening and closing control mechanism in a second embodiment of the present invention.
Figure 7:
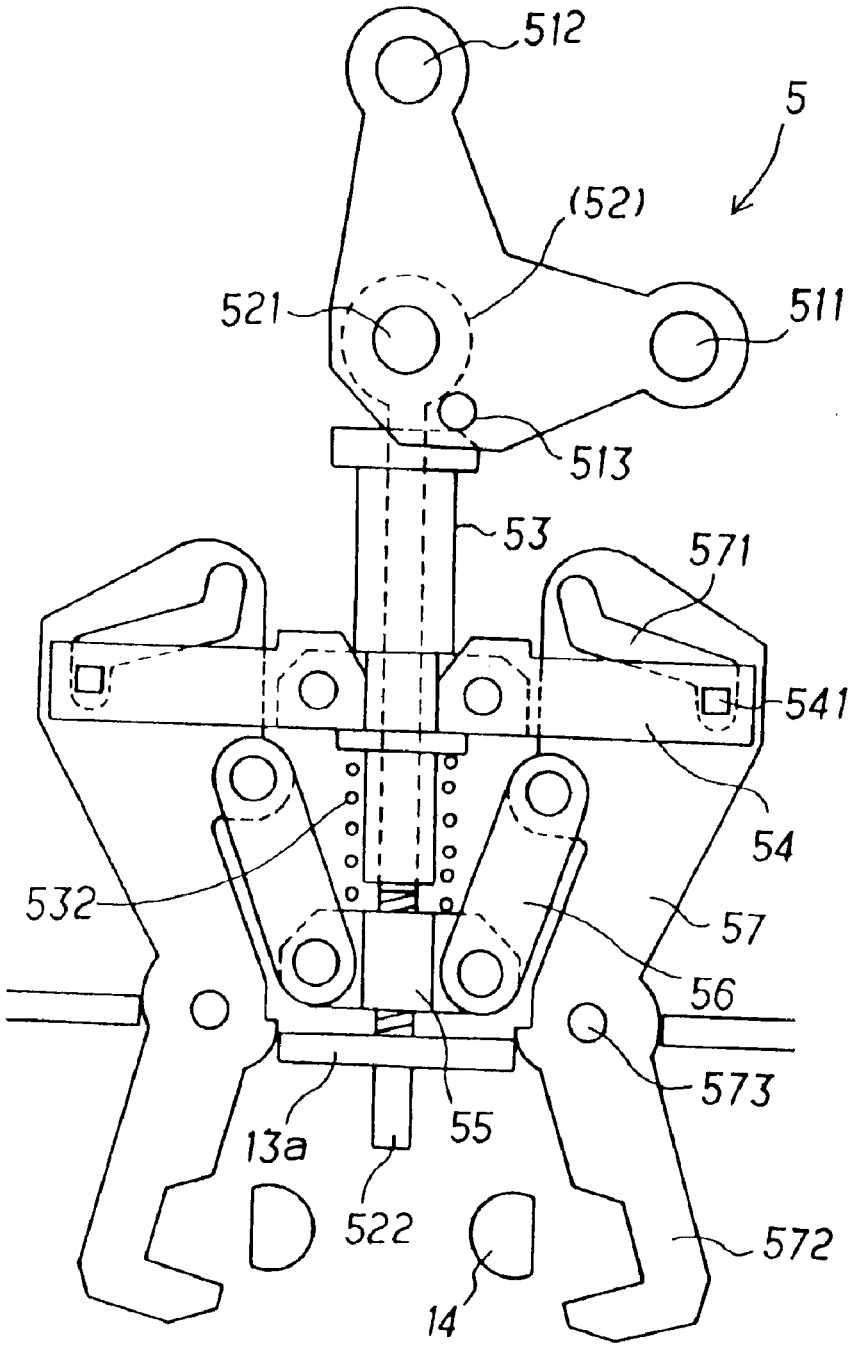
FIG. 7 is a partial front view showing the opening and closing control mechanism in the second embodiment of the present invention.

A second embodiment of the invention will be explained with reference to the drawings. Since a bottom opening type container itself is similar to that of the first embodiment, and there are many points common to the first embodiment regarding the opening and closing control mechanism, this embodiment will be explained mainly regarding different points below. FIGS. 6 and 7 are front views showing an opening and closing control mechanism in different states, respectively, according to this embodiment. The same reference numerals will be used for parts common to parts which have been explained previously.

51 denotes a lifting-up arm to which a hook is applied when the container is lifted up by a crane or the like. In this embodiment, the lifting-up arm 51 has two arms extending in different directions at an angle of 90° to each other about a pin 521 serving a rotation center, lifting holes 511 and 512 are provided in the respective arms, and a pushing-down pin 513 is provided near to the rotation center of the one arm.

In FIG. 6, the lifting hole 511 on the side where the pushing-down pin 513 is mounted is intended to be used for lifting. In this case, the pushing-down pin 513 is positioned at an ascended position and the sleeve 53 is positioned at an ascended position relative to the rod 52.

Next, in FIG. 7, the other lifting hole 512 of the lifting-up arm 51 is lifted up. In this case, the lifting-up arm 51 rotates by 90° and the pushing-down pin 513 pushes down the head portion of the sleeve 53.

Since the block 55 is pushed down by this action, the upper portions of the opening and closing arms 57 are drawn inward by the intermediate links 56, and the engaging hook portions 572 at lower end are opened outwardly, so that the engaging pins 14 are released. Thereby, the bottom plates can be opened.

One example of how to use a container using the opening and closing control mechanism 5 structured above will be explained as follows:

As shown in FIG. 6, in a case that the container is lifted up using the lifting hole 511 on the side where the pushing-down pin 513 is provided, the bottom plates do not open even when movement or lifting-down of the container is performed. After the container lands and a hook of the crane is reattached to another lifting hole 512, when the container is lifted up again and lands, the bottom plates are opened so that the contents are discharged. After discharging, the empty containers lands again and the hook is reattached to the other hole so that cargo handling work can be performed with the container whose bottom plates have been closed, again.

In this case, opening and closing of the bottom plates 11 of the container can be controlled by selecting one of the two lifting holes 511 and 512 so that an accident as erroneous opening of the bottom plates 11 can be prevented. In addition, all operations of lifting-up and lowering, a transverse movement, and opening and closing of the container can be performed by only operations in the crane, so that it is unnecessary to approach a lifted cargo which is dangerous for a worker.

Next, a third embodiment of the invention will be explained with reference to FIG. 8. Since this embodiment does not relate to the opening and closing control, the opening and closing control mechanism shown in the embodiment 1 or 2 may be used as the opening ad closing control mechanism 5.

In case that articles to be conveyed are rectangular timbers or the like, it is easy to discharge the content from a container where bottom plates 11 are completely opened at an angle of 90°. However, in case that the bottom plates 11 are opened at an angle of 90°, the bottom plates 11 can not be closed by merely lifting up the container 1 when the bottom plates 11 should be closed again. For this reason, there is a problem that a worker must assist in closing the bottom plates by performing some operations and the worker must approach the lifted cargo, which is dangerous. This embodiment solves this point and a returning mechanism is provided in at least one of the bottom plates 11.

The returning mechanism is structured by rotatably mounting another end of one lever 6 having a tip end hook 61 to a side face of the bottom plate 11 and hanging an intermediate portion of a spring 62 for tension. The size of the lever 6 is set to have such a length that the tip end hook 61 is engaged with the lifting-up arm 51 in a state where the bottom plate 11 is opened at an angle of 90° and the lifting-up arm 51 is fallen down without being lifted upwardly.

Figure 8:
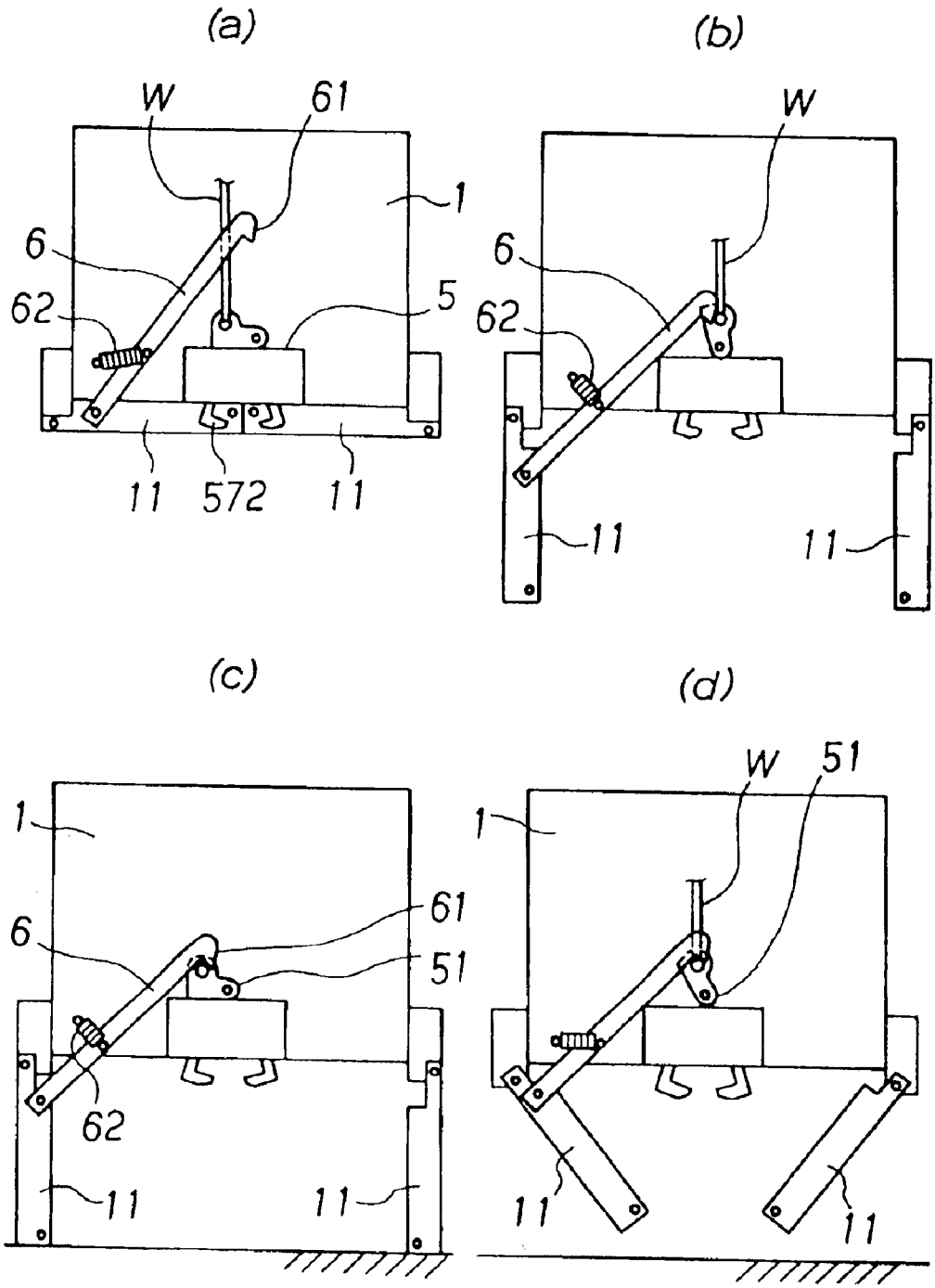
FIGS. 8*a–d* are front views showing an operation of a returning mechanism in a third embodiment of the present invention.

As shown in FIG. 8(*a*), when the bottom plates 11 are put in a closed state, the lever 6 is pulled to a standing state by a spring 62 so that the tip end hook 61 is put in an idle state. As shown in FIG. 8(*a*), when the bottom plates 11 are opened to discharge the contents from the container by operating the opening and closing control mechanism 5, the lever 6 is pulled up and the spring 62 is also made inactive, so that the lever 6 falls towards the opening and closing control mechanism 5.

As shown in FIG. 8(*c*), the container 1 lands in a state that the bottom plates 11 have been opened at an angle of 90°. When lifting-up means W is released or loosened, the lifting-up arm 51 falls down and the tip end hook 61 of the lever 6 is engaged with the lifting-up arm 51. Next, when the lifting-up means W is lifted up again, the lifting-up arm 51 stands up and the lever 6 draws the bottom plate 11 near to achieve the state shown in FIG. 8(*d*), so that, when the container lands again, the bottom plates 11 are closed by its own weight. As a result, the bottom plates 11 of the container can be closed by only operation of the crane without assistance of a worker.

Incidentally, in the case that articles to be handled are bulk cargoes and the contents can be discharged completely without opening the bottom plates 11 of the container up to an angle of 90°, this returning mechanism is not required.

Industrial Applicability

According to the invention, bottom plates of a container can be tightly closed without providing a clearance, one of automatic opening and closing can arbitrarily be selected by a simple operation, and this operation can be made at a safe place in advance. Furthermore, in the present invention, since a container is structured such that the bottom plates are opened at an angle of 90° and they can be closed without touching the container directly, such an excellent effect can be developed that articles other than bulk cargoes can be conveyed, and high efficiency of a cargo handling work and improvement of safety can be achieved.

What is claimed is:

1. A bottom opening type container comprising: a side plate and a pair of bottom plates; opening and closing shafts of the bottom plates mounted in the vicinity of a bottom portion of the side plate; engaging pins provided in the vicinity of tip ends of the bottom plates; a pair of opening and closing arms which are pivoted to opening and closing fulcrums fixed to the side plate and can retain the engaging pins at lower end portions; intermediate links having one end coupled to an upper portion of the opening and closing arms; a block connected to other ends of the intermediate links; a lifting rod screw-coupled to the block; a sleeve into which is inserted the lifting rod a rocker arm mounted in the vicinity of a lower end of the sleeve and ascends and descends together with the sleeve; a lifting-up arm coupled to the lifting rod via a pin; a manual lever inserted between the lifting-up arm and an upper end of the sleeve to be rotatable by 180° in a horizontal direction using the lifting rod as a rotation shaft; and a stopper provided at a lower portion of the manual lever to prevent the manual lever from lowering, wherein both end portions of the rocker arm are engaged with upper end portions of the opening and closing arms, the lifting-up arm has one short arm and one L-shaped arm on both sides about the pin serving as a rotation center, a pushing-down pin is provided near to the rotation center of the short arm and a lifting hole is provided at a tip end of the L-shaped arm, and S-shaped slits which are fitted to the rocker arm in left and right directions at respective positions of opening and closing are provided in the opening and closing arms.

2. A bottom opening type container according to claim 1, further comprising a returning mechanism comprising rotatably mounting one end of a lever having a tip end hook to a side face of the bottom plate and lifting an intermediate portion of the lever by a spring, the tip end hook is engaged with the lifting-up arm in a state where the bottom plate has been opened at 90° and the lifting-up arm has fallen down without being lifted upward.

3. A bottom opening type container comprising: a side plate and a pair of bottom plates; opening and closing shafts of the bottom plates mounted in the vicinity of bottom portion of the side plate; engaging pins provided in the vicinity of tip ends of the bottom plates; a pair of opening and closing arms which are pivoted to opening and closing fulcrums fixed to the side plate and can retain the engaging pins at lower end portions; intermediate links having one end coupled to upper portions of the opening and closing arm; a block which is connected to the other ends of the intermediate links; a lifting rod screw-coupled to the block; a sleeve into which is inserted the lifting rod; a rocker arm mounted in the vicinity of a lower end of the sleeve and which ascends and descends together with the sleeve; and a lifting-up arm coupled to the lifting rod via a pin, wherein both end portions of the rocker arm are engaged with upper end portions of the opening and closing arms, the lifting-up arm has two arms extending in different directions by 90° about the pin serving as a rotation center, lifting holes in the lifting-up arm, a pushing-down pin mounted hear to the rotation center of one arm, and S-shaped slits fitted to the rocker arm in left and right directions at respective positions of opening and closing are provided in the opening and closing arms.

4. A bottom opening type container according to claim 3, further comprising a return mechanism comprising rotatably mounting one of end of lever having a tip end hook to a side face of the bottom plate and lifting an intermediate portion of the lever by a spring, the tip end hook is engaged with the lifting-up arm in a state where the bottom plate has been opened at 90° and the lifting-up arm has fallen down without being lifted upward.

* * * * *

UNITED STATES PATENT AND TRADEMARK OFFICE

CERTIFICATE OF CORRECTION

PATENT NO. : 6,863,324 B1
APPLICATION NO. : 10/088818
DATED : March 8, 2005
INVENTOR(S) : Nakajima et al.

It is certified that error appears in the above-identified patent and that said Letters Patent is hereby corrected as shown below:

In the title page at (86), please change the date from "Dec. 31, 2002" to --September 23, 2002--.

In column 3, at line 27, please change "(52)" to --(52);--.

In column 7, at line 37, please change "content" to --contents--; and at line 39, please insert --the-- before "case".

Signed and Sealed this

First Day of August, 2006

JON W. DUDAS
*Director of the United States Patent and Trademark Office*